US005312709A

United States Patent [19]

Kadokura et al.

[11] Patent Number: 5,312,709

[45] Date of Patent: May 17, 1994

[54] IMAGE HOLDING MEMBER AND APPARATUS MAKING USE OF IT

[75] Inventors: Susumu Kadokura, Sagamihara; Fumio Sumino, Yokohama; Teigo Sakakibara, Tokyo, all of Japan

[73] Assignee: Canon Kabushiki Kaisha, Tokyo, Japan

[21] Appl. No.: 682,684

[22] Filed: Apr. 9, 1991

[30] Foreign Application Priority Data

Apr. 11, 1990 [JP] Japan ..... 2-96831
Apr. 12, 1990 [JP] Japan ..... 2-98345

[51] Int. Cl.[5] ..... G03G 5/10

[52] U.S. Cl. ..... 430/62; 430/108; 430/131

[58] Field of Search ..... 430/62, 127, 128, 131; 355/211; 358/302

[56] References Cited

U.S. PATENT DOCUMENTS

| | | | |
|---|---|---|---|
| 4,301,727 | 11/1981 | Bardin | 430/307 |
| 4,434,219 | 2/1984 | Sumino | 430/96 |
| 4,513,073 | 4/1985 | Jeffrey, III et al. | 430/65 |
| 4,696,764 | 9/1987 | Yamazaki | 524/401 |
| 4,920,022 | 4/1990 | Sakakibara et al. | 430/59 |
| 5,008,168 | 4/1991 | Nakagawa et al. | 430/56 |
| 5,145,733 | 9/1992 | Kadokura | 428/551 |

FOREIGN PATENT DOCUMENTS

| | | | |
|---|---|---|---|
| 2075365 | 11/1981 | United Kingdom | 430/63 |

*Primary Examiner*—John Goodrow
*Attorney, Agent, or Firm*—Fitzpatrick, Cella, Harper & Scinto

[57] ABSTRACT

An image holding member has support and an image holding layer provided on the support. The support has a substrate and a conductive electro-deposition coating film.

8 Claims, 1 Drawing Sheet

IMAGE HOLDING MEMBER AND APPARATUS MAKING USE OF IT

BACKGROUND OF THE INVENTION

1. Field of the Invention

The present invention relates to an image holding member that holds an electrostatic image or a toner image, and an apparatus making use of such a member.

2. Related Background Art

Electrostatic images or toner images are formed by various processes. Image holding members on which the electrostatic images or toner images are carried grouped into an image holding member having a photoconductive layer, called an electrophotographic photosensitive member, and an image holding member having no photoconductive layer.

The image holding members are usually comprised of a support and an image holding layer provided thereon.

Electrophotographic photosensitive members are constituted in various embodiments based on achievement of the desired performances or depending on the types of electrophotographic processes applied. A typical electrophotographic photosensitive member includes a photosensitive member comprised of a support and a photoconductive layer formed thereon as an image holding layer, and a photosensitive member comprised of a photoconductive layer as an image holding layer and an insulating layer laminated thereon. Both of these are in wide use. The photosensitive member comprised of a support and a photoconductive layer is used in forming images by the most commonly available electrophotographic process, i.e., by charging, imagewise exposure and development, and also optionally by transfer. In regard to the photosensitive member provided with an insulating layer, this insulating layer is provided for the purposes of protecting the photoconductive layer, improving mechanical strength of the photosensitive member and improving dark-decay characteristics, or so that the photosensitive member can be applied in a specific electrophotographic process as disclosed in Japanese Patent Publication No. 42-13910.

In a specific electrophotographic process, an electrostatic image is formed on the electrophotographic photosensitive member. This electrostatic image is developed and converted into a visible image.

The image holding member having no photoconductive layer typically includes a member having an insulating layer serving as an image holding layer. Some typical uses of this image holding member are as follows:

(1) An image holding member used in the following electrophotographic process: For example, as disclosed in Japanese Patent Publications No. 32-7115, No. 32-8204 and No. 43-1559, for the purpose of improving repeated usability of electrophotographic photosensitive members, an electrostatic image formed on an electrophotographic photosensitive member is developed after it has been transferred to an image holding member having no photoconductive layer, and then the toner image is transferred to a recording medium.

(2) An image holding member used in the following electrophotographic process: Electrical signals are applied to a multi-stylus electrode to form, corresponding with the electrical signals, an electrostatic image on the surface of an image holding member having no photoconductive layer, and the electrostatic image is developed to form a visible image.

Image holding members are commonly comprised of a conductive support and an image holding layer formed thereon. As the conductive support, it is common to use an aluminum drum whose surface has been mirror-finished. The mirror finishing is a measure necessary for achieving uniform thickness of the image holding layer and uniform electrostatic properties of the support and also to prevent image quality from being lowered. The mirror finishing, however, is a cause of an increase in cost, and hence it has been sought to provide an inexpensive and highly efficient support.

SUMMARY OF THE INVENTION

Accordingly, an object of the present invention is to realize at a low cost, without relying on means such as mirror-finishing, a conductive substrate that is uniform in both surface roughness and electrical performance, and to thus provide an image holding member that can give a good image.

In a first embodiment, the present invention provides an image holding member comprising a support and an image holding layer provided on said support, wherein said support comprises a substrate and a conductive layer comprising a conductive electro-deposition coating film, provided on the surface of said substrate.

In a second embodiment, the present invention provides a support for an image holding member, comprising a substrate and a conductive electro-deposition coating film provided on the surface of said substrate.

In a third embodiment, the present invention provides an electrophotographic apparatus comprising an electrophotographic photosensitive member comprising a support and an image holding layer provided on said support, wherein said support comprises a substrate and a conductive layer comprising a conductive electro-deposition coating film, provided on the surface of said substrate.

In a fourth embodiment, the present invention provides a facsimile machine comprising an electrophotographic apparatus and a receiver means for receiving image information from a remoto terminal; said electrophotographic apparatus comprising an electrophotographic photosensitive member comprising a support and an image holding layer provided on said support, wherein said support comprises a substrate and a conductive layer comprising a conductive electro-deposition coating film, provided on the surface of said substrate.

In a fifth embodiment, the present invention provides an image holding member comprising a support and an image holding layer provided on said support, wherein said support comprises a substrate and a conductive layer containing a ceramic powder whose particle surface are coated with a metal (hereinafter "metallized ceramic powder").

In a sixth embodiment, the present invention provides a support for an image holding member, comprising a substrate and a conductive layer containing a ceramic powder whose particle surfaces are coated with a metal, provided on the surface of said substrate.

In a seventh embodiment, the present invention provides an electrophotographic apparatus comprising an electrophotographic photosensitive member comprising a support and an image holding layer provided on said support, wherein said support comprises a substrate and a conductive layer containing a ceramic powder whose particle surfaces are coated with a metal, provided on the surface of said substrate.

In a eighth embodiment, the present invention provides a facsimile machine comprising an electrophotographic apparatus and a receiver means for receiving image information from a remote terminal; said electrophotographic apparatus comprising an electrophotographic photosensitive member comprising a support and an image holding layer provided on said support, wherein said support comprises a substrate and a conductive layer containing a ceramic powder whose particle surfaces are coated with a metal, provided on the surface of said substrate.

Use of such a conductive layer in the conductive support of an image holding member makes it possible (1) to give a uniform conductive layer without any particular smoothing even though its ground is rough, and (2) to use inexpensive plastics even if a metal such as aluminum is not used in the substrate. Thus, it becomes possible to provide a uniform conductive support at a low cost as aimed in the present invention.

DESCRIPTION OF THE PREFERRED EMBODIMENTS

Figure 1:
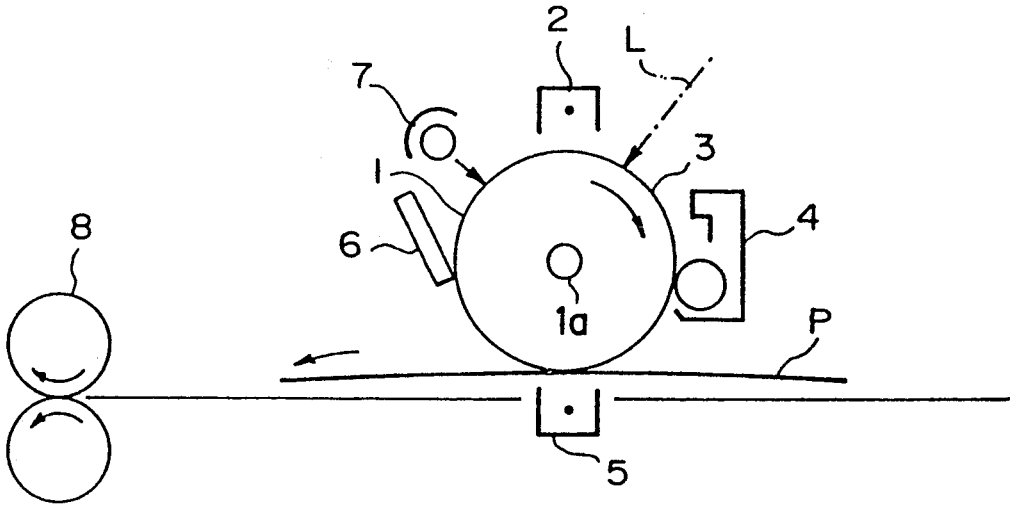
FIG. 1 schematically illustrates the constitution of a transfer electrophotographic apparatus commonly available, in which the image holding member of the present invention is used.

In the first embodiment of the present invention, an electro-deposition coating composition is used to form the electro-deposition coating film of the present invention. The electro-deposition coating composition usually comprises a resin feasible for electro-deposition, containing a conductive powder with an average particle diameter of 0.1 μm to 5 μm in an amount of 5 parts by weight to 50 parts by weight based on 100 parts by weight of the resin feasible for electro-deposition.

The substrate used in the present embodiment typically includes plastic materials, to which commonly known plating applied to plastics, i.e., electroless plating of a metal such as copper is applied in a thickness of 3 μm to 10 μm. Next, to prepare the electro-deposition coating composition, the conductive powder is dispersed in a commonly known low-temperature curing resin, preferably a resin of an acrylic melamine type, acrylic type, epoxy type, urethane type or alkyd type. It can be used in anionic or cationic electro-deposition coating.

In the anionic electro-deposition coating, the substrate is set as the anode, and a cationic electro-deposition coating, as the cathode. The electro-deposition is carried out under conditions of a bath temperature ranging from 20° C. to 25° C., an applied voltage of 50 V to 200 V, a current density of 0.5 $A/dm^2$ to 3 $A/dm^2$ and a treatment time of 1 minute to 5 minutes. Subsequently, the substrate with a coating is washed with water, followed by water break, and then the coating is cured in an oven of 90° C. to 100° C. for 20 minutes to 180 minutes. Thus the formation of the electro-deposition coating film is completed. In the coating film thus formed, the conductive powder is deposited together with the resin, in an amount of 10 parts by weight to 60 parts by weight, and preferably 30 parts by weight to 50 parts by weight, based on 100 parts by weight of the resin.

As the substrate, metals such as aluminum, copper and iron can also be used besides the above plastics. In this instance, a good support can be formed even if the substrate surface is not mirror-finished, because of the effect of smoothing to give a flat surface, attributable to the electro-deposition coating.

The conductive powder may include metal powders, metal foils and metal short fibers of aluminum, copper, nickel, silver, etc.; conductive metal oxides such as antimony oxide, indium oxide and tin oxide; polymeric conductive materials such as polypyrrole, polyaniline and polymeric electrolytes; carbon fiber, carbon black, and graphite powder.

In the present embodiment, it is suitable for the electro-deposition coating film to have a thickness of 5 μm to 50 μm, and particularly 10 μm to 30 μm.

The second embodiment of the present invention will be described below.

The metal powders have highly anisotropic forms and also, in respect of particle diameter, can not be obtained as so much fine powder. The metallized ceramics, however, have a wide allowance for the selection of shapes and particle diameters of the base material ceramics, and a very good conductive layer can be obtained if suitable base material ceramics are selected. In particular, the metallized ceramics can be very effective when combined with electro-deposition coating, making it possible to obtain the uniform conductive substrate at a low cost as aimed in the present invention.

The conductive layer containing the metallized ceramic powder can be formed by usual coating processes such as spray coating, dipping, laminating, brushing, knifing, spin coating, bar coating and roll coating. In particular, it is very advantageous to form the layer by electro-deposition coating, in view of the uniformity of the conductive layer and the deposition dispersibility of the metallized ceramic powder.

The electro-deposition coating is a process carried out using an electro-deposition coating composition prepared by dispersing the metallized ceramic powder in a resin feasible for electrodeposition as exemplified by an acrylic resin, an acrylic melamine resin, an epoxy resin, a urethane resin or an alkyd resin and then diluting the dispersion with desalted water to have a prescribed concentration. In this coating composition, the conductive layer containing the metallized ceramic powder is formed on the surface of the substrate by the action of electrophoresis.

The electro-deposition coating composition used when the conductive layer is formed by electro-deposition coating may contain the metallized ceramic powder in the resin usually in an amount of 1.0 part by weight to 30 parts by weight based on 100 parts by weight to 150 parts by weight of the resin feasible for electro-deposition.

The substrate used in the present embodiment also typically includes plastic materials, to which commonly known plating applied to plastics, i.e., electroless plating of a metal such as copper is applied in a thickness of 3 μm to 10 μm. Next, to prepare the electro-deposition coating composition, the ceramic powder whose particle surfaces are coated with a metal (i.e., the metallized ceramic powder) is dispersed in a commonly known low-temperature curing resin, preferably a resin of an acrylic melamine type, acrylic type, epoxy type, urethane type or alkyd type. It can be used in anionic or cationic electro-deposition coating. The metallized ceramic powder may have an average particle diameter, though variable depending on the purpose, of 0.1 μm to 5 μm, and preferably about 0.5 μm to about 2 μm, in order to increase contact surface areas. The average particle diameter of this powder is a value measured using a centrifugal sedimentation particle size distribution measuring device. A device actually used as this measuring device is SACP-3 (trade name; manufactured by Shimadzu Corporation). In order to satisfy 40 dB to 50 dB, the amount of dispersion of the powder should be in the range of 0.2 part by weight to 30 parts by weight, and preferably 10 parts by weight to 20 parts by weight, based on 100 parts by weight of the resin.

The coating on the particle surfaces of the ceramic powder may preferably be carried out by electroless plating of nickel or copper from the viewpoint of cost. Dispersion may be carried out for about 24 hours to about 35 hours using a ball mill. Thereafter, a dispersion formed is diluted with desalted water to have a concentration of 10 parts by weight to 15 parts by weight as the solid contents in electro-deposition coating commonly used. An electro-deposition coating composition can be thus obtained. A pigment may optionally be added to the coating composition for the purpose of coloring.

The ceramic powder that can be used may include aluminum oxide, mica, silicon carbide, silicon nitride, zirconium, niobium carbide, tantalum carbide and diamond powder.

In the anionic electro-deposition coating, the article to be coated is set as the anode, and the cationic electro-deposition coating, as the cathode. The electro-deposition is carried out under conditions of a bath temperature ranging from 20° C. to 25° C., an applied voltage of 50 V to 200 V, a current density of 0.5 A/dm$^2$ to 3 A/dm$^2$ and a treatment time of 1 minute to 5 minutes. Subsequently, the substrate with a coating is washed with water, followed by water break, and then the coating is cured in an oven of 90° C. to 100° C. for 20 minutes to 180 minutes. Thus the formation of the electro-deposition coating film is completed. In the coating film thus formed, the metallized ceramic powder is deposited in an amount of 5 parts by weight to 50 parts by weight, and preferably 10 parts by weight to 30 parts by weight, based on 100 parts by weight of the resin. The amount of the deposition is analyzed by a thermogravimetric apparatus.

An intermediate layer may also be optionally provided on the conductive layer for the purpose of controlling barrier properties or improving adhesion to the image holding layer.

Resin materials used in this intermediate layer may include polyether polyamides, and besides copolymer nylons, N-alkoxymethylated nylons, polyurethanes, polyureas, polyesters and phenol resins.

This intermediate layer may preferably have a thickness of 0.1 μm to 10 μm. It can be formed by commonly available coating processes such as dip coating, spray coating and roll coating, and also by electro-deposition coating.

In the case when the image holding member is an electrophotographic photosensitive member, the image holding layer may be either a photosensitive layer of laminated structure functionally separated into a charge generation layer and a charge transport layer, or a photosensitive layer of single-layer structure.

In the case of the photosensitive layer of laminated structure, the charge generation layer can be formed by dispersing a charge-generating material as exemplified by an azo pigment such as Sudan Red or Diane Blue, a quinone pigment such as pyrene quinone or anthanthrone, a quinocyanine pigment, a perylene pigment, an indigo pigment such as indigo or thioindigo, an azulenium salt pigment and a phthalocyanine pigment such as copper phthalocyanine, in a binder resin such as polyvinyl butyral, polystyrene, polyvinyl acetate, acrylic resin, polyvinyl pyrrolidone, ethyl cellulose or acetate butyrate cellulose, and coating the resulting dispersion on the intermediate layer described above. Such a charge generation layer may have a coating thickness of not more than 5 μm, and preferably 0.05 μm to 2 μm.

The charge transport layer provided on the charge generation layer can be formed using a coating solution prepared by dissolving a charge-transporting material as exemplified by a polycyclic compound having a structure such as biphenylene, anthracene, pyrene or phenanthrene on its main chain or side chain, a nitrogen-containing cyclic compound such as indole, carbazole, oxadiazole or pyrazoline, a hydrazone compound or a styryl compound, in a resin optionally having film-forming properties.

Such a resin having film-forming properties may include polyester, polycarbonate, polymethacrylate and polystyrene.

The charge transport layer may have a thickness of 5 μm to 40 μm, and preferably 10 μm to 30 μm.

The photosensitive layer of laminated structure may also have the structure that the charge generation layer is laminated on the charge transport layer.

In the case of the photosensitive layer of single-layer type, the photosensitive layer can be formed by incorporating into a resin the charge-generating material and charge-transporting material as described above. It is also possible to use an organic photoconductive polymer layer comprising polyvinyl carbazole or polyvinyl anthracene; a selenium deposited layer, a selenium-tellurium deposited layer or an amorphous silicon layer.

As for the support used in the present embodiment, it is common to use a support molded into a drum or a sheet.

In the case when the image holding member has no photoconductive layer, the image holding layer serves as an insulating layer. Resins used to form such an insulating layer may include thermoplastic resins such as polyamide, polyester, acrylic resin, polyaminoacid ester, polyvinyl acetate, polycarbonate, polyvinyl formal, polyvinyl butyral, polyvinyl alkyl ethers, polyalkylene ethers and polyurethane elastomers, and thermosetting resins such as thermosetting polyurethanes, phenol resins and epoxy resins.

FIG. 1 schematically illustrates an example of the constitution of a transfer electrophotographic apparatus in which a drum photosensitive member according to the present invention is used.

In FIG. 1, the numeral 1 denotes a drum photosensitive member serving as an image supporting member, which is rotated around a shaft 1*a* at a given peripheral speed in the direction shown by the arrow. In the course of rotation, the photosensitive member 1 is uniformly charged on its periphery, with positive or negative applied potential by the operation of a charging means 2, and then photoimagewise exposed to light L (slit exposure, laser beam scanning exposure, etc.) at an exposure zone 3 by the operation of an imagewise exposure means (not shown). As a result, electrostatic latent images corresponding to the exposure images are successively formed on the periphery of the photosensitive member.

The electrostatic latent images thus formed are subsequently developed by toner by the operation of a developing means 4. The resulting toner-developed images are then successively transferred by the operation of a transfer means 5, to the surface of a transfer medium P fed from a paper feed section (not shown) to the part between the photosensitive member 1 and the transfer means 5 in the manner synchronized with the rotation of the photosensitive member 1.

The transfer medium P on which the images have been transferred is separated from the surface of the photosensitive member and led through an image-fixing means 8, where the images are fixed and then delivered to the outside as a transcript (a copy).

The surface of the photosensitive member 1 after the transfer of images is cleaned of the toner remaining after the transfer, using a cleaning means 6. Thus the photosensitive member is cleaned on its surface, further subjected to charge elimination by a pre-exposure means 7, and then repeatedly used for the formation of images.

The charging means 2 for giving uniform charge on the photosensitive member 1 include corona chargers, which are commonly put into wide use. As the transfer apparatus 5, corona transfer means are also commonly put into wide use.

The electrophotographic apparatus may be constituted of a combination of plural components joined as one device unit from among the constituents such as the above photosensitive member, developing means and cleaning means so that the unit can be freely mounted on or detached from the body of the apparatus. For example, the photosensitive member 1 and the cleaning means 6 may be joined into one device unit so that the unit can be freely mounted or detached using a guide means such as a rail provided in the body of the apparatus. Here, the above device unit may be so constituted as to be joined together with the charging means and/or the developing means.

In the case when the electrophotographic apparatus is used as a copying machine or a printer, the photosensitive member is exposed to optical image exposing light L by irradiation with light reflected from, or transmitted through, an original, or by the scanning of a laser beam, the driving of an LED array or the driving of a liquid crystal shutter array according to signals obtained by reading an original with a sensor and converting the information into signals.

Figure 2:
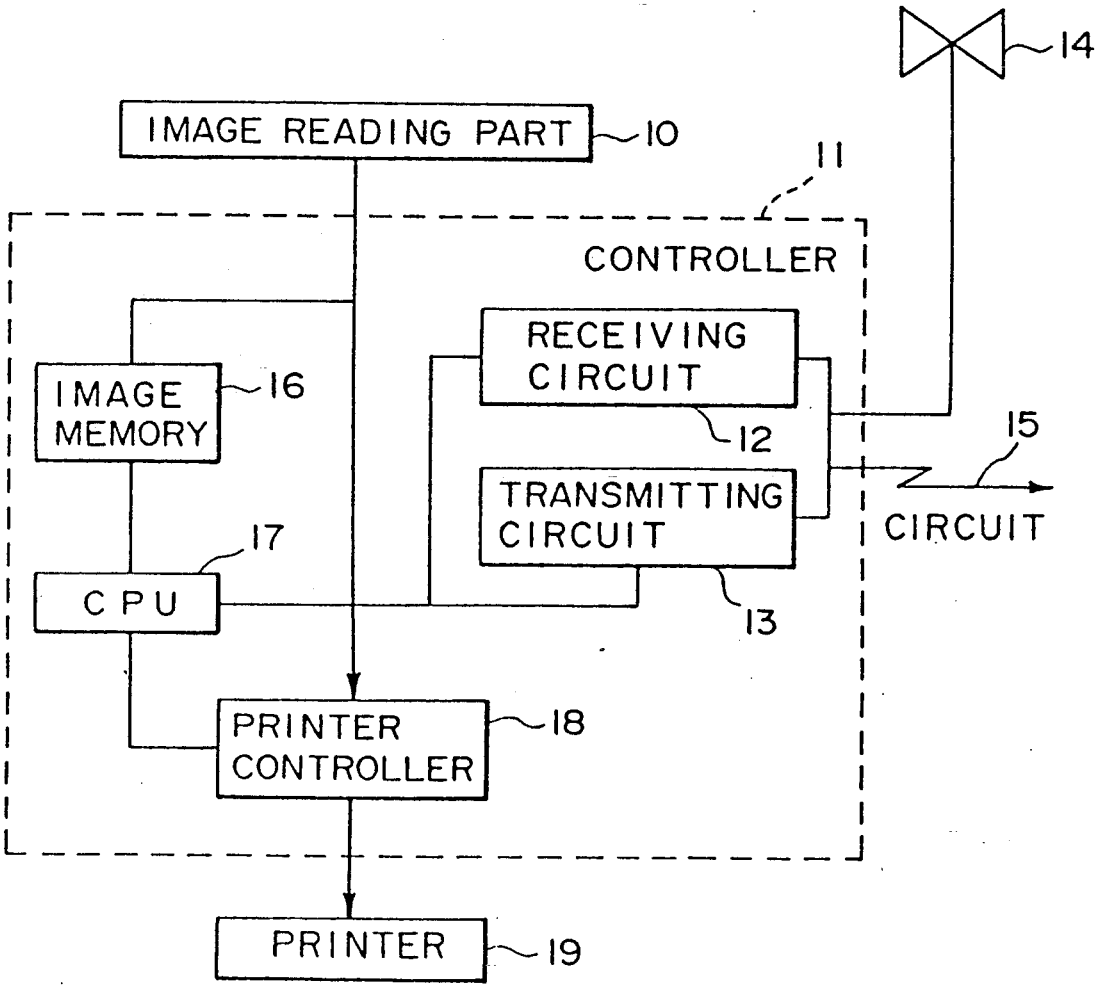
FIG. 2 is a block diagram of a facsimile system in which the image holding member of the present invention is used.

When used as a printer of a facsimile machine, the optical image exposing light L serves as exposing light used for the printing of received data. FIG. 2 illustrates an example thereof in the form of a block diagram.

As shown in FIG. 2, a controller 11 controls an image reading part 10 and a printer 19. The whole of the controller 11 is controlled by CPU 17. Image data outputted from the image reading part is sent to the other facsimile station through a transmitting circuit 13. Data received from the other station is sent to a printer 19 through a receiving circuit 12. Given image data are stored in an image memory 16. A printer controller 18 controls the printer 19. The numeral 14 denotes a telephone.

An image received from a circuit 15 (image information from a remote terminal connected through the circuit) is demodulated in the receiving circuit 12, and then successively stored in an image memory 16 after the image information is decoded by the CPU 17. Then, when images for at least one page have been stored in the memory 16, the image recording for that page is carried out. The CPU 17 reads out the image information for one page from the memory 16 and sends the coded image information for one page to the printer controller 18. The printer controller 18, having received the image information for one page from the CPU 17, controls the printer 19 so that the image information for one page is recorded.

The CPU 17 receives image information for next page in the course of the recording by the printer 19.

Images are received and recorded in the above way.

EXAMPLE 1-1

A plastic cylinder of 80 mm in outer diameter and 5 mm of wall thickness was treated with an etchant of a $CrO_3$—$H_2SO_4$—$H_2O$ system for 1 minute. After washing with water, the resulting cylinder was treated at room temperature for 2 minutes using as a sensitizer solution a solution comprised of 30 g/lit. of stannous chloride and 20 ml/lit. of hydrochloric acid, followed by washing with water. Subsequently, using as an activator solution a solution comprised of 0.3 g/lit. of palladium chloride and 3 ml/lit. of hydrochloric acid, the cylinder was further treated at room temperature for 2 minutes to make its surface conductive. Thereafter, using an electroless copper plating solution (produced by Okuno Seiyaku Kogyo K.K.) of pH 13.0, plating was carried out at a bath temperature of 70° C. for 3 minutes to form a copper thin film of 0.1 μm thick. Subsequently, using an aqueous solution of 5% of sodium hydroxide and 1% of potassium persulfate, the surface of the copper thin film was treated at 70° C. for 30 seconds to form a copper oxide film, a chemically colored film.

Then, in 100 parts by weight of an acrylic melamine resin (trade name: Honey Bright C-IL; produced by Honey Chemical Co.), 15 parts by weight of copper particles with an average particle diameter of 0.07 μm was dispersed for 30 hours using a ball mill, and then the dispersion was diluted with desalted water to 15% by weight as a concentration of solid contents, followed by further addition of 2.0% by weight of carbon black for the purpose of coloring to make up a coating composition. Using this coating composition, electro-deposition was carried out at an applied voltage of 150 V for 3 minutes under conditions of a bath temperature of 25° C. and pH 8 to 9, setting the article to be coated as the anode and a 0.5 t stainless steel sheet as the opposing electrode. After the electro-deposition, the coated article was washed with water and then heated in an oven of 97° C.±1° C. for 60 minutes to effect curing. An electro-deposition coating film (a conductive layer) was thus formed in a thickness of 20 μm.

The average particle diameter of copper particles was calculated according to the following expression, as dense spheres having the same particle diameters. (The same applies hereinafter with regard to the average particle diameter.)

$$\text{Average particle diameter } (\mu m) = \frac{6}{\text{Specific gravity} \times \text{Specific surface area } (m^2/g)}$$

Next, on the above conductive layer, a solution prepared by dissolving 10 parts by weight of tetrapolymer nylon (average molecular weight: 14,000; trade name: Amilan CM-8000; produced by Toray Industries, Inc.) in a mixed solvent of 60 parts by weight of methanol and 30 parts by weight of 1-butanol was coated by dip coating in a coating thickness of 1.0 μm, followed by drying at 60° C. for 30 minutes to form an intermediate layer.

Next, 10 parts by weight of a disazo pigment of the following structural formula:

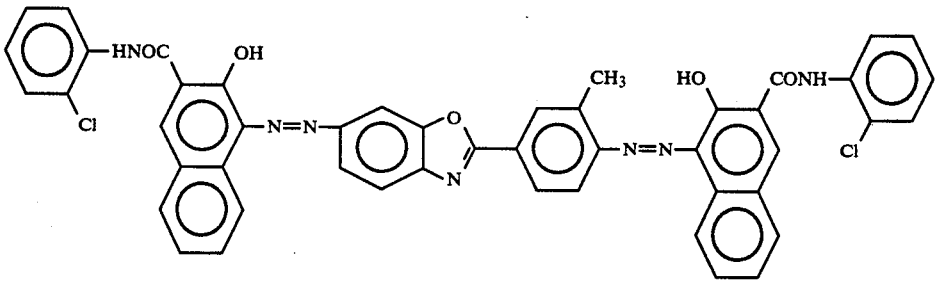

6 parts by weight of an acetate butyrate cellulose resin (trade name: CAB-381; produced by Eastman Kagaku K.K.) and 60 parts of cyclohexane were dispersed for 20 hours by means of a sand mill in which glass beads of 1 mm in diameter were used. To the resulting dispersion, 100 parts by weight of methyl ethyl ketone was added, and then the solution was coated on the above intermediate layer by dip coating, followed by drying at 100° C. for 10 minutes to form a charge generation layer with a coating thickness of 0.1 μm.

Next, 10 parts by weight of a hydrazone compound having the following structural formula:

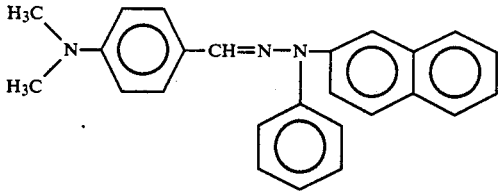

and 12 parts by weight of a styrene-methyl methacrylate copolymer (trade name: MS-200; produced by Seitestu Kagaku Co., Ltd.) were dissolved in 80 parts by weight of toluene. The resulting solution was coated on the above charge generation layer by dip coating, followed by hot-air drying at 100° C. for 1 hour to form a charge transport layer with a thickness of 20 μm.

The photosensitive member produced in this way was fitted to an electrophotographic copying machine having the steps of −5.6 kV corona charging, image-wise exposure, dry toner developing, toner transfer to plain paper, and cleaning by means of a urethane rubber blade. Images were produced to evaluate image quality. As a result, very good images were obtained.

In particular, when compared with a photosensitive member comprising a cylinder provided thereon with a conductive layer by dip coating of a coating composition comprised of carbon black dispersed in a melamine resin, followed by repetition of Example 1 to form the intermediate layer, the charge generation layer and the charge transport layer, the photosensitive member of the present invention was found to be superior thereto in the denseness of halftone images.

EXAMPLE 1-2

An aluminum cylinder of 80 mm in outer diameter, 1 mm of wall thickness and Rz=2.0 μm in surface roughness was subjected to chromate treatment in a 0.1 wt. % $CrO_3$ solution. Subsequently, in 100 parts by weight of an acrylic melamine resin (trade name: Honey Bright C-IL; produced by Honey Chemical Co.), 10 parts by weight of Ni particles with an average particle diameter of 0.05 μm was dispersed for 30 hours using a ball mill, and then the dispersion was diluted with desalted water to 15% by weight as a concentration of solid contents, followed by further addition of 2.0% by weight of carbon black for the purpose of coloring to make up a coating composition. Using this coating composition, electro-deposition was carried out at an applied voltage of 150 V for 3 minutes under conditions of a bath temperature of 25° C. and pH 8 to 9, setting the article to be coated as the anode and a 0.5 t stainless steel sheet as the opposing electrode. After the electro-deposition, the coated article was washed with water and then heated in an oven of 97° C.±1° C. for 60 minutes to effect curing. An electro-deposition coating film (a conductive layer) was thus formed.

Next, on the above conductive layer, an ethanol solution (solid content: 15% by weight) of a resol type phenol resin (average molecular weight: 1,000; trade name: Plyophen 5010; produced by Dainippon Ink & Chemicals, Incorporated) was coated by dip coating in a coating thickness of 1.0 μm, followed by drying at 140° C. for 10 minutes to effect curing. Thus an intermediate layer was formed.

Next, 10 parts by weight of an ε-type copper phthalocyanine of the following structural formula:

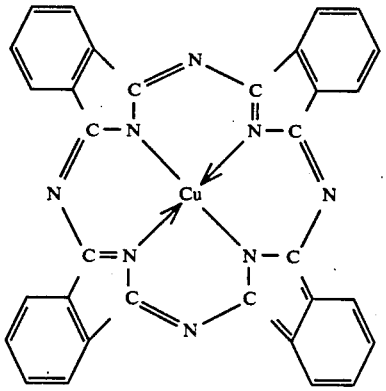

and 10 parts by weight of a polyvinyl butyral resin (trade name: S-LEC BM-2; produced by Sekisui Chemical Co., Ltd.) were dispersed for 10 hours together with 120 parts by weight of cyclohexanone by means of a sand mill in which glass beads of 1 mm in diameter were used. To the resulting dispersion, 30 parts by weight of methyl ethyl ketone was added, and then the solution was coated on the above intermediate layer, followed by drying at 100° C. for 10 minutes to form a charge generation layer with a coating thickness of 0.15 μm.

Next, 10 parts by weight of the same hydrazone compound as used in Example 1-1 and 12 parts by weight of a polycarbonate resin (molecular weight: 20,000; trade name: IUPILON Z-200; produced by Mitsubishi Gas Chemical Company, Inc.) were dissolved in 80 parts by weight of monochlorobenzene. The resulting solution was coated on the above charge generation layer by dip coating, followed by hot-air drying at 100° C. for 1 hour to form a charge transport layer with a thickness of 20 μm.

The photosensitive member produced in this way was fitted to a laser beam printer carrying out reversal development using a semiconductor laser (oscillation wavelength λ: 780 nm) as a light source, and images were produced to evaluate image quality. As a result, very good images were obtained. In particular, no black dots around images were found to occur even under conditions of high temperature and high humidity (temperature: 30° C.; relative humidity: 85%).

EXAMPLE 1-3

The same cylinder as used in Example 1-1 was treated with an etchant of a $CrO_3$—$H_2SO_4$—$H_2O$ system for 1 minute. After washing with water, the resulting cylinder was treated at room temperature for 2 minutes using as a sensitizer solution a solution comprised of 30 g/lit. of stannous chloride and 20 ml/lit. of hydrochloric acid, followed by washing with water. Subsequently, using as an activator solution a solution comprised of 0.3 g/lit. of palladium chloride and 3 ml/lit. of hydrochloric acid, the cylinder was further treated at room temperature for 2 minutes to make its surface conductive. Thereafter, using an electroless copper plating solution (produced by Okuno Seiyaku Kogyo K.K.) of pH 13.0, plating was carried out at a bath temperature of 70° C. for 3 minutes to form a copper thin film of 0.2 μm thick. Subsequently, using an aqueous solution of 5% of sodium hydroxide and 1% of potassium persulfate, the surface of the copper thin film was treated at 70° C. for 30 seconds to form a copper oxide film, a chemically colored film.

Then, in 100 parts by weight of an acrylic melamine resin (trade name: Honey Bright C-IL; produced by Honey Chemical Co.), 12 parts by weight of Ag particles with an average particle diameter of 0.07 μm was dispersed for 30 hours using a ball mill, and then the dispersion was diluted with desalted water to 15% by weight as a concentration of solid contents, followed by further addition of 2.0% by weight of carbon black for the purpose of coloring to make up a coating composition. Using this coating composition, electro-deposition was carried out at an applied voltage of 120 V for 3 minutes under conditions of a bath temperature of 25° C. and pH 8 to 9, setting the article to be coated as the anode and a 0.5 t stainless steel sheet as the opposing electrode. After the electro-deposition, the coated article was washed with water and then heated in an oven of 97° C.±1° C. for 60 minutes to effect curing. An electro-deposition coating film (a conductive layer) was thus formed.

Next, on the above conductive layer, a solution prepared by mixing 100 parts by weight of a photocurable polyfunctional polyester acrylate resin (trade name: ARONIX M-7000X; produced by Toagosei Chemical Industry Co., Ltd.), 80 parts by weight of a low-molecular weight ethylene tetrafluoride resin powder (trade name: LUBRON L-2; produced by Daikin Industries, Ltd.), 2 parts by weight of polyvinyl butyral (trade name: S-LEC BM-2; produced by Sekisui Chemical Co., Ltd.), 30 parts by weight of fine aluminum oxide powder $Al_2O_3$ (trade name: White Alundum #8000; Fuji Kenmazai K.K.) and 100 parts by weight of methyl ethyl ketone, followed by dispersion for 24 hours by means of a sand mill in which aluminum oxide balls were used, was coated by dip coating. The coating formed was irradiated with light of a 4 kW high-pressure mercury lamp for 3 minutes to effect drying and curing. Thus an insulating layer with a coating thickness of 25 μm was formed.

The image holding member produced in this way was fitted to a printer having the steps of forming an electrostatic latent image using a multi-stylus electrode, dry toner developing, toner transfer to plain paper, and cleaning by means of a rubber blade. Images were produced to evaluate image quality. As a result, very good images were obtained.

EXAMPLE 1-4

The same cylinder as used in Example 1-2 was subjected to chromate treatment in a solution of 1.0% by weight of $CrO_3$. Subsequently, in 100 parts by weight of an acrylic melamine resin (trade name: Honey Bright C-IL; produced by Honey Chemical Co.), 10 parts by weight of Cu particles with an average particle diameter of 0.02 μm was dispersed for 30 hours using a ball mill, and then the dispersion was diluted with desalted water to 15% by weight as a concentration of solid contents, followed by further addition of 2.0% by weight of carbon black for the purpose of coloring to make up a coating composition. Using this coating composition, electro-deposition was carried out at an applied voltage of 150 V for 3 minutes under conditions of a bath temperature of 25° C. and pH 8 to 9, setting the article to be coated as the anode and a 0.5 t stainless steel sheet as the opposing electrode. After the electro-deposition, the coated article was washed with water and then heated in an oven of 97° C.±1° C. for 60 minutes to effect curing. An electro-deposition coating film (a conductive layer) was thus formed.

Next, on the above conductive layer, a solution prepared by dissolving 10 parts by weight of methoxymethylated nylon (trade name: Toresin EF-30T; produced by Teikoku Chemical Industry Co., Ltd.) in a mixed solvent of 60 parts by weight of methanol and 30 parts by weight of 1-butanol was coated by dip coating in a coating thickness of 1.0 μm, followed by drying at 60° C. for 30 minutes to form an intermediate layer.

Next, 10 parts by weight of a disazo pigment of the following structural formula:

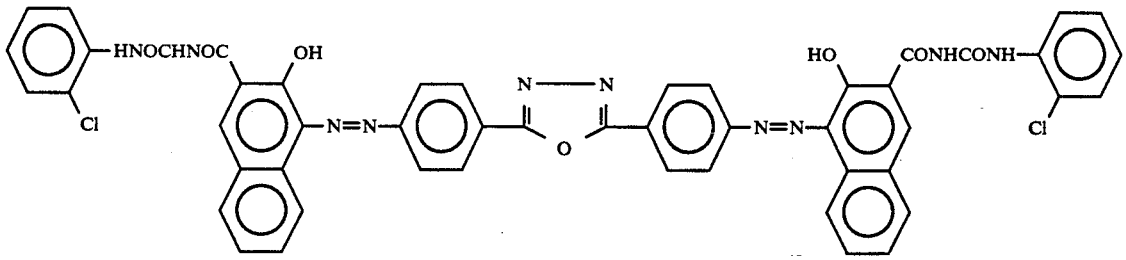

and 10 parts by weight of a polyvinyl butyral resin (trade name: S-LEC BL-S; produced by Sekisui Chemical Co., Ltd.) were dispersed for 10 hours together with 120 parts by weight of cyclohexane by means of a sand mill in which glass beads of 1 mm in diameter were used. To the resulting dispersion, 100 parts by weight of methyl ethyl ketone was added, and then the solution was coated on the above intermediate layer by dip coating, followed by drying at 100° C. for 10 minutes to form a charge generation layer with a coating thickness of 0.1 μm.

Next, 10 parts by weight of a styryl compound of the following structural formula and 12 parts by weight of a polycarbonate resin (molecular weight: 20,000; trade name: IUPILON Z-200; produced by Mitsubishi Gas Chemical Company, Inc.) were dissolved in 80 parts by weight of monochlorobenzene. The resulting solution was coated on the above charge generation layer by dip coating, followed by hot-air drying at 100° C. for 1 hour to form a charge transport layer with a thickness of 20 μm.

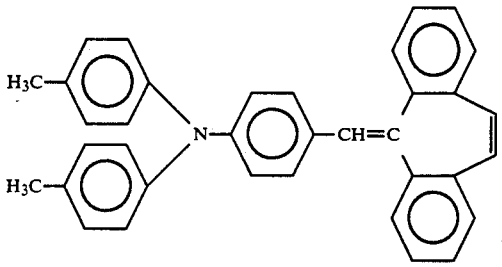

The photosensitive member produced in this way was fitted to the same electrophotographic copying machine as used in Example 1-1 , and images were evaluated similarly. As a result, very good images were obtained.

EXAMPLE 1-5

The same cylinder as used in Example 1-1 was treated with an etchant of a $CrO_3$—$H_2SO_4$—$H_2O$ system for 1 minute. After washing with water, the resulting cylinder was treated at room temperature for 2 minutes using as a sensitizer solution a solution comprised of 30 g/lit. of stannous chloride and 20 ml/lit. of hydrochloric acid, followed by washing with water. Subsequently, using as an activator solution a solution comprised of 0.3 g/lit. of palladium chloride and 3 ml/lit. of hydrochloric acid, the cylinder was further treated at room temperature for 2 minutes to make its surface conductive. Thereafter, using an electroless copper plating solution (produced by Okuno Seiyaku Kogyo K.K.) of pH 13.0, plating was carried out at a bath temperature of 70° C. for 3 minutes to form a copper thin film of 0.1 μm thick. Subsequently, using an aqueous solution of 5% of sodium hydroxide and 1% of potassium persulfate, the surface of the copper thin film was treated at 70° C. for 30 seconds to form a copper oxide film, a chemically colored film.

Then, in 100 parts by weight of an acrylic melamine resin (trade name: Honey Bright C-IL; produced by Honey Chemical Co.), 10 parts by weight of Ni particles with an average particle diameter of 0.03 μm was dispersed for 30 hours using a ball mill, and then the dispersion was diluted with desalted water to 15% by weight as a concentration of solid contents, followed by further addition of 2.0% by weight of carbon black for the purpose of coloring to make up a coating composition. Using this coating composition, electro-deposition was carried out at an applied voltage of 150 V for 3 minutes under conditions of a bath temperature of 25° C. and pH 8 to 9, setting the article to be coated as the anode and a 0.5 t stainless steel sheet as the opposing electrode. After the electro-deposition, the coated article was washed with water and then heated in an oven of 97° C.±1° C. for 60 minutes to effect curing. An electro-deposition coating film (a conductive layer) was thus formed.

Next, 10 parts by weight of a hydrazone compound of the following structural formula:

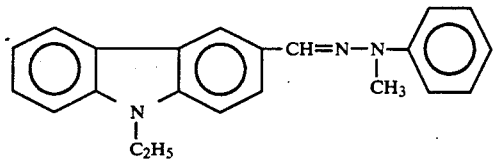

and 12 parts by weight of a polycarbonate resin (molecular weight: 20,000; trade name: IUPILON Z-200; produced by Mitsubishi Gas Chemical Company, Inc.) were dissolved in 80 parts by weight of monochlorobenzene. The resulting solution was coated on the above conductive layer by dip coating, followed by hot-air drying at 100° C. for 1 hour to form a charge transport layer with a thickness of 20 μm.

Next, 5 parts by weight of a disazo pigment of the following structural formula:

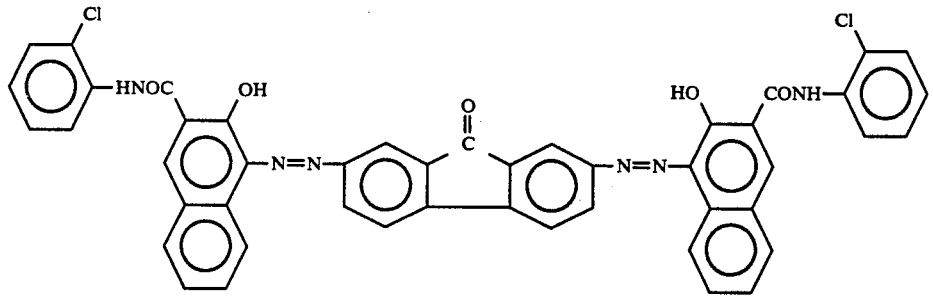

10 parts by weight of the same polycarbonate resin as the above and 5 parts by weight of a low-molecular weight ethylene tetrafluoride resin powder (trade name: LUBRON L-2; produced by Daikin Industries, Ltd.) were mixed and then dispersed for 10 hours together with 100 parts by weight of monochlorobenzene by means of a sand mill in which glass beads of 1 mm in diameter were used. To the resulting dispersion, 50 parts by weight of dichloromethane was added, and then the solution was coated on the above charge transport layer by spray coating, followed by drying at 100° C. for 1 hour to form a charge generation layer with a coating thickness of 20 μm.

The photosensitive member produced in this way was fitted to the same electrophotographic copying machine as used in Examples 1-1 and 1-4 except that it was modified to perform primary charging and transfer charging in plus polarities and also a negative toner was used. Images were produced to make evaluation. As a result, very uniform and good images were obtained.

EXAMPLE 1-6

The same cylinder as used in Example 1-2 was subjected to chromate treatment in a solution of 1.0% by weight of $CrO_3$. Subsequently, in 100 parts by weight of an acrylic melamine resin (trade name: Honey Bright C-IL; produced by Honey Chemical Co.), 10 parts by weight of Cu particles with an average particle diameter of 0.02 μm was dispersed for 30 hours using a ball mill, and then the dispersion was diluted with desalted water to 15% by weight as a concentration of solid contents, followed by further addition of 2.0% by weight of carbon black for the purpose of coloring to make up a coating composition. Using this coating composition, electro-deposition was carried out at an applied voltage of 120 V for 3 minutes under conditions of a bath temperature of 25° C. and pH 8 to 9, setting the article to be coated as the anode and a 0.5t stainless steel sheet as the opposing electrode. After the electro-deposition, the coated article was washed with water and then heated in an oven of 97° C.±1° C. for 60 minutes to effect curing. An electro-deposition coating film (a conductive layer) was thus formed.

Next, on the above conductive layer, an intermediate layer comprising the same methoxymethylated nylon as in Example 1-4 was formed in a coating thickness of 10 μm.

Next, 4 parts by weight of a quinone pigment of the following structural formula:

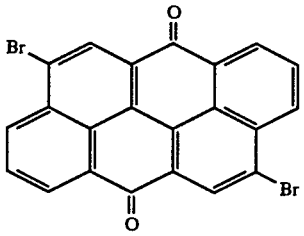

40 parts by weight and 10 parts by weight of the same polycarbonate resin and low-molecular weight ethylene tetrafluoride resin powder, respectively, as in Example 1-5 and 40 parts by weight of a biphenyl compound of the following structural formula:

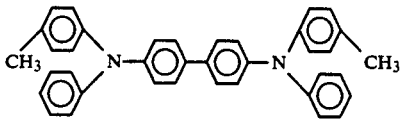

were mixed, and dispersed for 10 hours together with 150 parts by weight of monochlorobenzene by means of a sand mill in which glass beads of 1 mm in diameter were used. To the resulting dispersion, 50 parts by weight of dichloromethane was added, and then the solution was coated on the above intermediate layer by dip coating, followed by drying at 100° C. for 1 hour to form a photosensitive layer with a thickness of 20 μm.

The photosensitive member produced in this way was fitted to the plus-polarity-adapted electrophotographic copying machine as used in Example 1-5, and images were produced to evaluate image quality. As a result, very good images were obtained.

Example 2-1

A cupric oxide film was formed on a plastic cylinder in the same manner as in Example 1-1.

Then, in 100 parts by weight of an acrylic melamine resin (trade name: Honey Bright C-IL; produced by Honey Chemical Co.), 10 parts by weight of aluminum oxide with an average particle diameter of 1 μm whose particle surfaces were coated with nickel by electroless plating in a thickness of 2 μm was dispersed for 30 hours using a ball mill, and then the dispersion was diluted with desalted water to 15% by weight as a concentration of solid contents, followed by further addition of 2.0% by weight of carbon black for the purpose of coloring to make up a coating composition. Using this coating composition, electro-deposition was carried out at an applied voltage of 150 V for 3 minutes under conditions of a bath temperature of 25° C. and pH 8 to 9, setting the article to be coated as the anode and a 0.5t stainless steel sheet as the opposing electrode. After the electro-deposition, the coated article was washed with water and then heated in an oven of 97° C.±1° C. for 60 minutes to effect curing. An electro-deposition coating film with a thickness of 20 μm was thus formed.

On the electro-deposition coating film thus formed, a charge generation layer and a charge transport layer were provided in the same manner as in Example 1-1. A photosensitive member was thus produced.

The photosensitive member produced in this way was fitted to an electrophotographic copying machine having the steps of −5.6 kV corona charging, image-wise exposure, dry toner developing, toner transfer to plain paper, and cleaning by means of a urethane rubber blade. A 10,000 sheet running test was carried out. As a result, very good images were obtained and a superior stability was also shown in respect of potential.

COMPARATIVE EXAMPLE 1

A conductive layer was provided on a cylinder by dip coating using a coating composition prepared by dispersing aluminum powder in a heat-curable urethane resin. Subsequently an intermediate layer, a charge generation layer and a charge transport layer were provided in the same manner as in Example 2-1 to produce a photosensitive member. A comparison with this photosensitive member revealed that the photosensitive member of Example 2-1 was confirmed to be superior in potential stability. Results are shown in Table 1 below.

EXAMPLE 2-2

A conductive layer was provided on a cylinder by dip coating using a coating composition prepared by dispersing the same metallized ceramic powder as used in Example 2-1, in the same heat-curable urethane resin as used in Comparative Example 1. Subsequently an intermediate layer, a charge generation layer and a charge transport layer were provided in the same manner as in Example 2-1 to produce a photosensitive member. A comparison with this photosensitive member revealed that the photosensitive member of Example 2-2 was confirmed to show a good potential stability, but a slightly poorer image uniformity than that of Example 2-1. Results obtained are shown in Table 1.

TABLE 1

| | Dark portion potential | Light portion potential | Image |
|---|---|---|---|
| Example 2-1 | | | |
| (1): | −700 | −150 | Good |
| (2): | −660 | −200 | Good |
| Comparative Example 1 | | | |
| (1): | −700 | −140 | Good |
| (2): | −520 | −210 | Low density with coarseness |
| Example 2-2 | | | |
| (1): | −700 | −140 | Good |
| (2): | −620 | −190 | Coarseness |

(1): Initial stage
(2): After 10,000 sheet running

EXAMPLE 2-3

An aluminum cylinder of 80 mm in outer diameter, 1 mm of wall thickness and Rz=2.0 μm in surface roughness was subjected to chromate treatment in a 0.1 wt. % $CrO_3$ solution. Subsequently, in 100 parts by weight of an acrylic melamine resin (trade name: Honey Bright C-IL; produced by Honey Chemical Co.), 10 parts by weight of aluminum oxide with an average particle diameter of 1 μm whose particle surfaces were coated with copper by electroless plating in a thickness of 0.5 μm was dispersed for 30 hours using a ball mill, and then the dispersion was diluted with desalted water to 15% by weight as a concentration of solid contents, followed by further addition of 2.0% by weight of carbon black for the purpose of coloring to make up a coating composition. Using this coating composition, electro-deposition was carried out at an applied voltage of 150 V for 3 minutes under conditions of a bath temperature of 25° C. and pH 8 to 9 setting the article to be coated as the anode and a 0.5 t stainless steel sheet as the opposing electrode. After the electro-deposition, the coated article was washed with water and then heated in an oven of 97° C.±1° C. for 60 minutes to effect curing. An electro-deposition coating film was thus formed.

Next, an intermediate layer, a charge generation layer and a charge transport layer were formed in the same manner as in Example 1-2 to produce a photosensitive member.

The photosensitive member produced in this way was fitted to a laser beam printer carrying out reversal development using a semiconductor laser (oscillation wavelength λ:780 nm as a light source, and a 10,000 sheet running test was carried out. As a result, very good images were obtained and also a superior stability was shown in respect of potential. In particular, stable images were obtained with less variation in both the dark portion potential and the light portion potential even under conditions of high temperature and high humidity (temperature: 30° C.; relative humidity: 85%).

EXAMPLE 2-4

A copper oxide film was formed on a cylinder in the same manner as in Example 1-3.

Then, in 100 parts by weight of an acrylic melamine resin (trade name: Honey Bright C-IL; produced by Honey Chemical Co.), 10 parts by weight of silicon carbide with an average particle diameter of 0.7 μm whose particle surfaces were coated with nickel by electroless plating in a thickness of 0.1 μm was dispersed for 30 hours using a ball mill, and then the dispersion was diluted with desalted water to 15% by weight as a concentration of solid contents, followed by further addition of 2.0% by weight of carbon black for the purpose of coloring to make up a coating composition. Using this coating composition, electro-deposition was carried out at an applied voltage of 120 V for 3 minutes under conditions of a bath temperature of 25° C. and pH 8 to 9, setting the article to be coated as the anode and a 0.5 t stainless steel sheet as the opposing electrode. After the electro-deposition, the coated article was washed with water and then heated in an oven of 97° C.±1° C. for 60 minutes to effect curing. An electro-deposition coating film was thus formed.

Next, an insulating layer was formed in the same manner as in Example 1-3.

The image holding member produced in this way was fitted to a printer having the steps of forming an electrostatic latent image using a multi-stylus electrode, dry toner developing, toner transfer to plain paper, and cleaning by means of a rubber blade. A 100,000 sheet running test was carried out to confirm that the image holding member showed a superior stability of latent images.

EXAMPLE 2-5

The same cylinder as used in Example 1-2 was subjected to chromate treatment in a solution of 1.0% by weight of $CrO_3$. Subsequently, in 100 parts by weight of an acrylic melamine resin (trade name: Honey Bright C-IL; produced by Honey Chemical Co.), 10 parts by weight of aluminum oxide with an average particle diameter of 0.2 μm whose particle surfaces were coated with copper by electroless plating in a thickness of 0.2 μm was dispersed for 30 hours using a ball mill, and then the dispersion was diluted with desalted water to 15% by weight as a concentration of solid contents, followed by further addition of 2.0% by weight of carbon black for the purpose of coloring to make up a coating composition. Using this coating composition, electro-deposition was carried out at an applied voltage of 150 V for 3 minutes under conditions of a bath temperature of 25° C. and pH 8 to 9, setting the article to be coated as the anode and a 0.5 t stainless steel sheet as the opposing electrode. After the electro-deposition, the coated article was washed with water and then heated in an oven of 97° C.±1° C. for 60 minutes to effect curing. An electro-deposition coating film was thus formed.

Next, an intermediate layer, a charge generation layer and a charge transport layer were formed in the same manner as in Example 1-4 to produce a photosensitive member.

The photosensitive member produced in this way was fitted to the same electrophotographic copying machine as used in Example 2-1, and a 10,000 sheet running test was carried out. As a result, very good images were obtained and also a superior stability was shown in respect of potential.

EXAMPLE 2-6

A copper oxide film was formed on a cylinder in the same manner as in Example 1-5.

Then, in 100 parts by weight of an acrylic melamine resin (trade name: Honey Bright C-IL; produced by Honey Chemical Co.), 10 parts by weight of aluminum oxide with an average particle diameter of 1 μm whose particle surfaces were coated with copper by electroless plating in a thickness of 0.1 μm was dispersed for 30 hours using a ball mill, and then the dispersion was diluted with desalted water to 15% by weight as a concentration of solid contents, followed by further addition of 2.0% by weight of carbon black for the purpose of coloring to make up a coating composition. Using this coating composition, electro-deposition was carried out at an applied voltage of 150 V for 3 minutes under conditions of a bath temperature of 25° C. and pH 8 to 9, setting the article to be coated as the anode and a 0.5 t stainless steel sheet as the opposing electrode. After the electro-deposition, the coated article was washed with water and then heated in an oven of 97° C.±1° C. for 60 minutes to effect curing. An electro-deposition coating film was thus formed.

Next, a charge transport layer and a charge generation layer were formed in the same manner as in Example 1-5 to produce a photosensitive member.

The photosensitive member produced in this way was fitted to the same electrophotographic copying machine as used in Examples 2-1 and 2-5 except that it was modified to perform primary charging and transfer charging in plus polarities and also a negative toner was used. A 10,000 sheet running test was carried out. As a result, very uniform and good images were obtained and also a superior stability was shown in respect of potential.

EXAMPLE 2-7

The same cylinder as used in Example 2-3 was subjected to chromate treatment in a solution of 1.0% by weight of $CrO_3$. Subsequently, in 100 parts by weight of an acrylic melamine resin (trade name: Honey Bright C-IL; produced by Honey Chemical Co.), 10 parts by weight of silicon nitride with an average particle diameter of 1.0 μm whose particle surfaces were coated with copper by electroless plating in a thickness of 0.2 μm was dispersed for 30 hours using a ball mill, and then the dispersion was diluted with desalted water to 15% by weight as a concentration of solid contents, followed by further addition of 2.0% by weight of carbon black for the purpose of coloring to make up a coating composition. Using this coating composition, electro-deposition was carried out at an applied voltage of 120 V for 3 minutes under conditions of a bath temperature of 25° C. and pH 8 to 9, setting the article to be coated as the anode and a 0.5 t stainless steel sheet as the opposing electrode. After the electro-deposition, the coated article was washed with water and then heated in an oven of 97° C.±1° C. for 60 minutes to effect curing. An electro-deposition coating film was thus formed.

Next, on the above electro-deposition coating film, an intermediate layer and a photosensitive layer were formed in the same manner as in Example 1-6 to produce a photosensitive member.

The photosensitive member produced in this way was fitted to the same plus-polarity-adapted electrophotographic copying machine as used in Example 2-6, and a 10,000 sheet running test was carried out. As a result, very good images were obtained and also a superior stability was shown in respect of potential.

We claim:

1. An image holding member comprising a support and a photoconductive layer provided on said support, wherein said support comprises a substrate and a conductive layer comprising a conductive electro-deposition coating film provided on the surface of said substrate, said coating film having conductive powder dispersed in a resin and said conductive powder being electrodeposited together with the resin.

2. An image holding member according to claim 1, wherein an intermediate layer is provided between said image holding layer and said support.

3. An electrophotographic apparatus comprising an electrophotographic photosensitive member comprising a support and a photoconductive layer provided on said support, wherein said support comprises a substrate and a conductive layer comprising a conductive electro-deposition coating film, provided on the surface of said substrate, said coating film having conductive powder dispersed in a resin and said conductive powder being electrodeposited together with the resin.

4. A facsimile machine comprising an electrophotographic apparatus and a receiver means for receiving image information from a remote terminal;

said electrophotographic apparatus comprising an electrophotographic photosensitive member comprising a support and a photoconductive layer provided on said support, wherein said support comprises a substrate and a conductive layer comprising a conductive electro-deposition coating film, provided on the surface of said substrate, said coating film having conductive powder dispersed in a resin and said conductive powder being electrodeposited together with the resin.

5. An image holding member comprising a support and a photoconductive layer provided on said support, wherein said support comprises a substrate and a conductive layer containing a ceramic powder whose particle surfaces are coated with a metal, said conductive layer having the ceramic powder dispersed in a resin and said ceramic powder being electrodeposited together with the resin.

6. An image holding member according to claim 5, wherein an intermediate layer is provided between said image holding layer and said support.

7. An electrophotographic apparatus comprising an electrophotographic photosensitive member comprising a support and a photoconductive layer provided on said support, wherein said support comprises a substrate and a conductive layer containing a ceramic powder whose particle surfaces are coated with a metal, provided on the surface of said substrate.

8. A facsimile machine comprising an electrophotographic apparatus and a receiver means for receiving image information from a remote terminal;

said electrophotographic apparatus comprising an electrophotographic photosensitive member comprising a support and a photoconductive layer provided on said support, wherein said support comprises a substrate and a conductive layer containing a ceramic powder whose particle surfaces are coated with a metal, provided on the surface of said substrate.

* * * * *